United States Patent [19]

Kraemer

[11] 4,309,700

[45] Jan. 5, 1982

[54] CATHODE RAY TUBE CONTROLLER

[75] Inventor: Alan D. Kraemer, Tustin, Calif.

[73] Assignee: Technology Marketing, Inc., Irvine, Calif.

[21] Appl. No.: 152,432

[22] Filed: May 22, 1980

[51] Int. Cl.[3] ..... G09G 1/16

[52] U.S. Cl. ..... 340/726; 340/723; 340/744; 340/789; 340/749

[58] Field of Search ..... 340/723, 744, 745, 789, 340/799, 749, 726

[56] References Cited

U.S. PATENT DOCUMENTS

| | | | |
|---|---|---|---|
| 3,624,632 | 11/1971 | Ophir | 340/799 X |
| 3,659,283 | 4/1972 | Ophir | 340/749 X |
| 3,676,850 | 7/1972 | Goldman et al. | 340/726 X |
| 3,771,155 | 11/1973 | Hayashi et al. | 340/799 X |
| 4,070,662 | 1/1978 | Narveson | 340/726 |
| 4,189,727 | 2/1980 | Vaughn | 340/799 X |

*Primary Examiner*—David L. Trafton

*Attorney, Agent, or Firm*—Knobbe, Martens, Olson, Hubbard & Bear

[57] ABSTRACT

A cathode ray tube controller provides character cell mapping of the entire cathode ray tube screen, including the blanked margins. This mapping permits video control signals, such as sync signals, blanking signals, retrace signals, etc., as well as character address designations, to be generated from a single ROM in each of the vertical and horizontal directions on the cathode ray tube screen. A horizontal character counter divides the cathode ray tube screen, including the blanked margin areas, into an integral number of character widths. This counter is used to address a read only member which provides, at its output, the horizontal character addressing in the non-blanked area of the cathode ray tube screen, as well as video control signals, including blanking signals, sync signals, etc. A vertical counter, similar to the horizontal counter, divides the entire cathode ray tube screen vertically, including the blanked areas, into a discrete number of character heights. Its output addresses a read only memory which provides both line address signals and vertical video control signals, such as sync signals and blanking signals. The system significantly reduces the amount of logic required to generate video control signals and addressing signals for the refresh memory. Partial screen scrolling is accomplished by duplicating the y axis read only memory to effectively animate the video screen using plural scroll images.

27 Claims, 4 Drawing Figures

CATHODE RAY TUBE CONTROLLER

BACKGROUND OF THE INVENTION

This invention relates to cathode ray tube controllers and, more specifically, to a circuit for generating video control signals, as well as character address signals, for providing a cathode ray tube character display.

Cathode ray tube controllers for the digital control of video displays are common in the prior art. In particular, systems for generating alpha-numeric character displays are commonly provided in word processing, accounting, communication, and general computer peripheral applications.

Because of the need, in generating a cathode ray tube video display, to continually and repetitively refresh the information written on the display, it is common to utilize a writable memory (RAM) having a discrete addressable location for each character to be displayed on the video screen. Complex systems are provided for sequentially addressing this RAM to provide, at the output of the RAM, a sequence of digital words identifying the characters to be visually displayed at successive character locations on the screen.

These digital words typically supply the input to a character generator read only memory (ROM). This character generator ROM is additionally supplied with data words which identify the particular raster lines within the letter which, at any time, are being scanned by the cathode ray gun. In response to these inputs, the character generator ROM provides an output word identifying the graphical content of each cathode ray tube raster line required to generate the identified characters. A shift register, coupled to the output of a character generator ROM, generates pulse signals, in sequence, for controlling the on and off state of the cathode ray gun to graphically reproduce the characters.

The present invention deals specifically with the electronic system used for generating the input address data words to the refresh RAM and for providing other video control signals, such as blanking signals and sync signals.

In the prior art, these address and video control signals have typically been provided by a pair of horizontal counters and a pair of vertical counters. The first counter in the horizontal pair has been used to provide video control signals, such as horizontal sync signals and blanking signals. This first counter counts a system clock, to whatever counting base is needed, based on the clock rate, to produce a horizontal sync signal when the counter is full. The counter thus repetitively counts until full, generates a horizontal sync signal, and then repeats the count.

The second horizontal counter is slaved to the first, so that, when the first counter generates a count indicating that the blanked margin on the left-hand side of the screen has been traced, the second counter beings its count. This second counter typically includes one count for each character space in the portion of the screen actually to be filled with character information. The second counter thus finishes its count at the location of the right-hand margin on the screen, and the first horizontal counter continues its count until retrace occurs at the horizontal sync point.

The vertical counter pair operates in a similar manner, with the first vertical counter providing video control signals, such as the vertical sync signal, and the second counter, slaved to the first, counting actual character line locations in the non-blanked vertical portion of the cathode ray tube screen. The first vertical counter is slaved to the sync output of the first horizontal counter, since the first horizontal counter provides one sync output for each raster line. The first vertical counter thus counts raster lines throughout the entire vertical dimension of the cathode ray tube screen.

The second horizontal counter and second vertical counter provide x and y data matrix address information to define cells for the characters to be displayed on the screen. In order to linearize this data, for storage in a one-dimensional refresh RAM, the prior art has commonly utilized a ROM as a translator for the output of the second vertical counter. If the second horizontal counter counted an even binary multiple of horizontal character widths, across the non-blanked portion of the cathode ray tube screen, this ROM would not be necessary, since the horizontal and vertical address outputs could be concatenated to provide a discrete address for the refresh RAM without leaving gaps within the refresh ROM between horizontal lines.

Since an 80-character width line is common, however, and since the numeral 80 is not an integral binary multiple, the translating ROM provides base addresses, with each successive base address offset from the previous base address, in binary form, by 80. This permits the output of the translating ROM and the second horizontal counter to be added, the sum providing the address for the refresh RAM.

The counter chains required by the prior art systems described above, and particularly the first horizontal counter and the first vertical counter, incorporate a large amount of digital logic circuitry which makes the systems relatively expensive and decreases their reliability.

Furthermore, these prior art systems present extreme problems when partial screen scrolling is to be accomplished. From the above description, it will be understood that, by simply loading an offset into the second vertical counter, and by periodically increasing that offset, the entire screen display can be vertically scrolled. Such scrolling is desirable, for example, when the screen is filled and additional lines are added by an operator.

It has been found advantageous in the prior art to scroll most of the character lines on the screen while holding some character lines stationary, such as, for example, a base line providing margin information, etc. The prior art systems were able to provide such partial scrolling with stationary screen portions, during scrolling, only through the use of expensive and complex digital logic networks, further substantially adding to the cost of prior art systems.

SUMMARY OF THE INVENTION

The present invention alleviates these and other problems associated with the prior art by effectively character mapping the entire cathode ray tube screen. Thus, while only a portion of the screen will actually be filled with characters, the character mapping in the border regions allows all of the video control signals, as well as the refresh RAM address signals, to be generated from a counter driven ROM in each of the horizontal and vertical directions. Since the vertical ROM can also provide the base address translation, the prior art first vertical counter is eliminated altogether. Furthermore, since the x and y counters, which drive the ROM in the present invention, count only character divisions on the screen, relatively simple and inexpensive counter chains, similar in size and cost to the second horizontal counter and second vertical counter of the prior art, may be utilized. Thus, the present invention significantly reduces the logic required for refresh RAM addressing. In addition, since the single horizontal and vertical ROM are also used for providing video control signals, the system complexity is significantly reduced, without any degradation in system performance. In fact, system performance, in many instances, is actually increased, since the ability to read video control signals out of a ROM permits extremely flexible video control.

The present invention also provides a simplified circuit for partial video screen scrolling. It is often advantageous to scroll the horizontal lines of the screen to permit additional lines to be added, for example, when the screen is full. The present invention effectively permits animation of the screen in the vertical direction by enlarging the size of the vertical ROM to provide multiple screen image translations, each translation providing offset base addresses for the lines to be scrolled. This extremely simple solution to the scrolling problem allows any grouping of lines to be scrolled and any grouping, as desired, to be held stationary. In fact, the ROM used in this fashion allows virtually limitless flexibility in rearranging displayed material on the cathode ray tube screen.

Replacement of the vertical ROM with a RAM permits reduction in the size of this memory and even greater flexibility in display arrangement.

DESCRIPTION OF THE DRAWINGS

These and other advantages of the present invention are best understood through reference to the drawings, in which.

DETAILED DESCRIPTION OF THE PREFERRED EMBODIMENT

Figure 1:
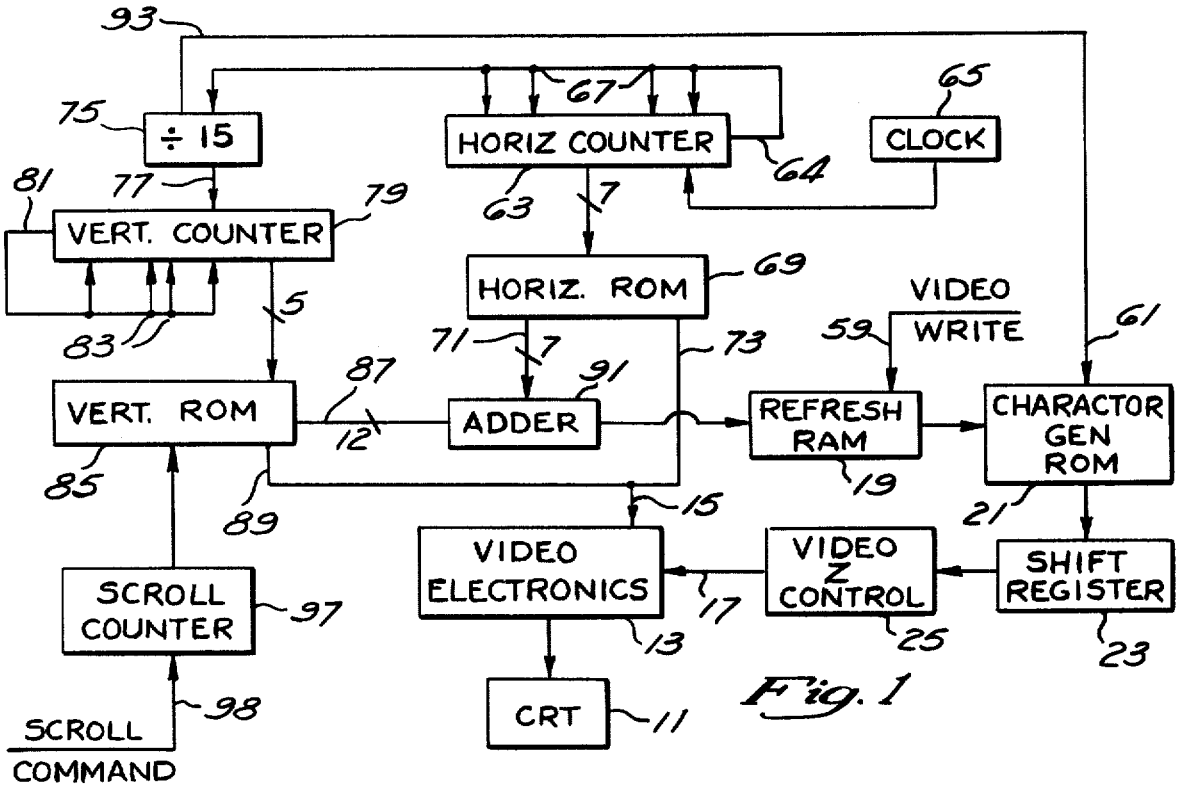
FIG. 1 is a block diagram schematic of the cathode ray tube controller of the present invention.

Referring initially to FIG. 1, a cathode ray tube 11 is connected to a video electronics driving circuit 13. Both of these devices 11, 13 are well known in the art, and the use of a plurality of video control signals on line 15 and picture information signals on line 17 for the video electronics 13 is also well known. The video control signals 15 provide horizontal synchronization, vertical synchronization, other timing signals, blanking signals, etc., for the video electronics 13. The input 17 provides the information for controlling the z axis of a CRT 11, that is, the voltage on the cathode ray tube gun. Thus, the input 15 effectively synchronizes and controls the horizontal and vertical deflection of the cathode ray tube 11 while the input 17 provides the necessary information for producing graphics on the screen 11.

When the cathode ray tube 11 is to be used as a character generator, the use of a refresh RAM 19, a character generator ROM 21, a shift register 23, and a video control circuit 25, in combination to form the input 17, is also well known. Nonetheless, these elements 19 through 25 will be briefly described, since an understanding of their operation is helpful in understanding the present invention.

Figure 2:
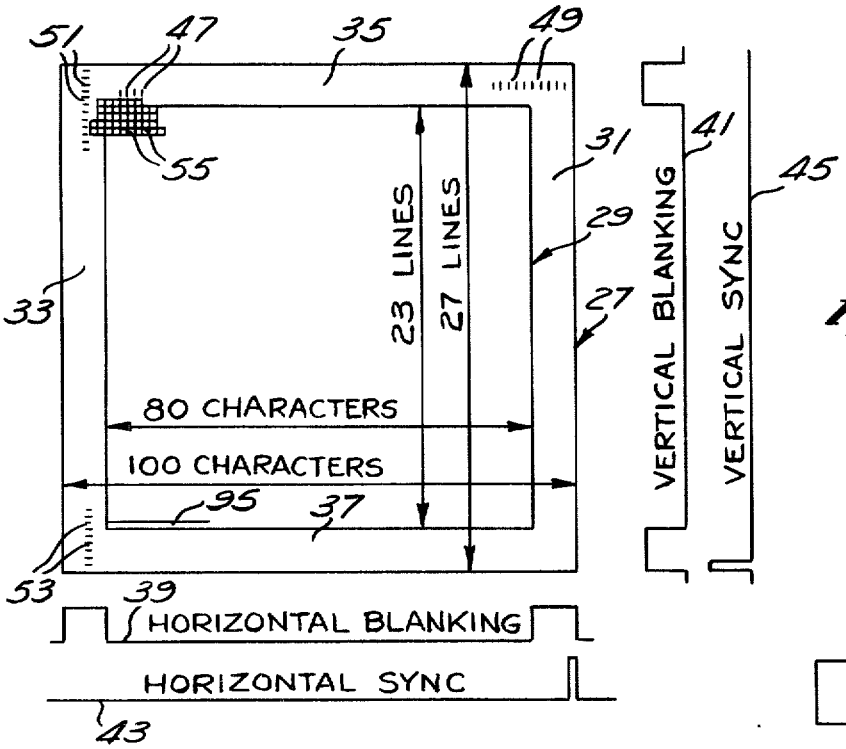
FIG. 2 is a graphic representation of the cathode ray tube screen and the method of character mapping of this screen according to the present invention.

FIG. 2 shows the screen 27 of the cathode ray tube 11 of FIG. 1. As was common in the prior art, a central portion 29 of the screen 27 actually displays characters, while right and left hand margins 31 and 33 and top and bottom margins 35 and 37 are provided surrounding the image area 29.

It is common to provide a horizontal blanking signal, such as the signal 39, to blank the cathode ray gun at the margins 31, 33. A vertical blanking signal 41 is also commonly used, this signal providing control for blanking the cathode ray gun in the margin areas 35, 37.

Image display cathode ray tubes typically do not provide interlaced raster lines, and thus the beam from the cathode ray gun will scan across a substantially horizontal line from left to right in FIG. 2 until it reaches the extreme right-hand side of the screen 27, at which time a horizontal sync signal, shown at 43, triggers a retrace. Thus, the scanning gun immediately flies back to the left-hand margin to begin the next horizontal trace, displaced slightly below the previous horizontal trace. In this way, the entire screen 27 is scanned by the cathode ray gun through a rapid succession of raster lines. When the cathode ray gun reaches the lower extremity of the screen 27, a vertical sync signal 45 generates a vertical retrace, causing the cathode ray gun to again initiate a first horizontal raster line at the top of the screen 27.

In the prior art, it has been common to divide the image area 29, horizontally and vertically, into character cells. In the present invention, the entire screen 27 is divided into character cells. Thus, a plurality of horizontal character cell divisions 47 and 49 are shown in FIG. 2. It will be understood that these divisions 47, 49 are not actually represented on the screen 27, but provide a graphical indication that the entire width of the screen 27 is divided into character locations 47, 49. Similarly, in the prior art, it was common to divide the image area 29 vertically into character lines. In the present invention, as graphically depicted at 51 and 53, the entire vertical dimension of the screen 27 is divided into character lines 51, 53.

From the preceding description, assuming that both the horizontal character divisions 47, 49 and the vertical character lines 51, 53 are individually numbered or identified, the entire screen 27 is mapped by horizontal character location and vertical line location. In the example shown in FIG. 2, eighty horizontal character locations exist within the image area 29, as a part of one hundred horizontal character locations on the screen 27. Likewise, twenty-three vertical line locations within the image area 29 form a part of twenty-seven vertical line locations within the screen 27.

As will be understood from the description which follows, the character cell mapping of the entire screen 27 provides a unique advantage in the present invention in that it permits a single read only memory to generate not only addressing signals for the image area 29, but also video control signals, both within the image area 29 and in the margin areas 31 through 37.

Character cells, defined by the horizontal character spaces 47, 49, and vertical line spaces 51, 53, are designated 55 in FIG. 2. In the exemplary embodiment, described below, each of these character cells 55 will provide a single character within the image area 29, as well as the space surrounding such characters. It will be understood that in non-character generator embodiments, for example, graphic displays may fill the entire character cell 55, so that contiguous graphics may be displayed in the image area 29.

Figure 3:
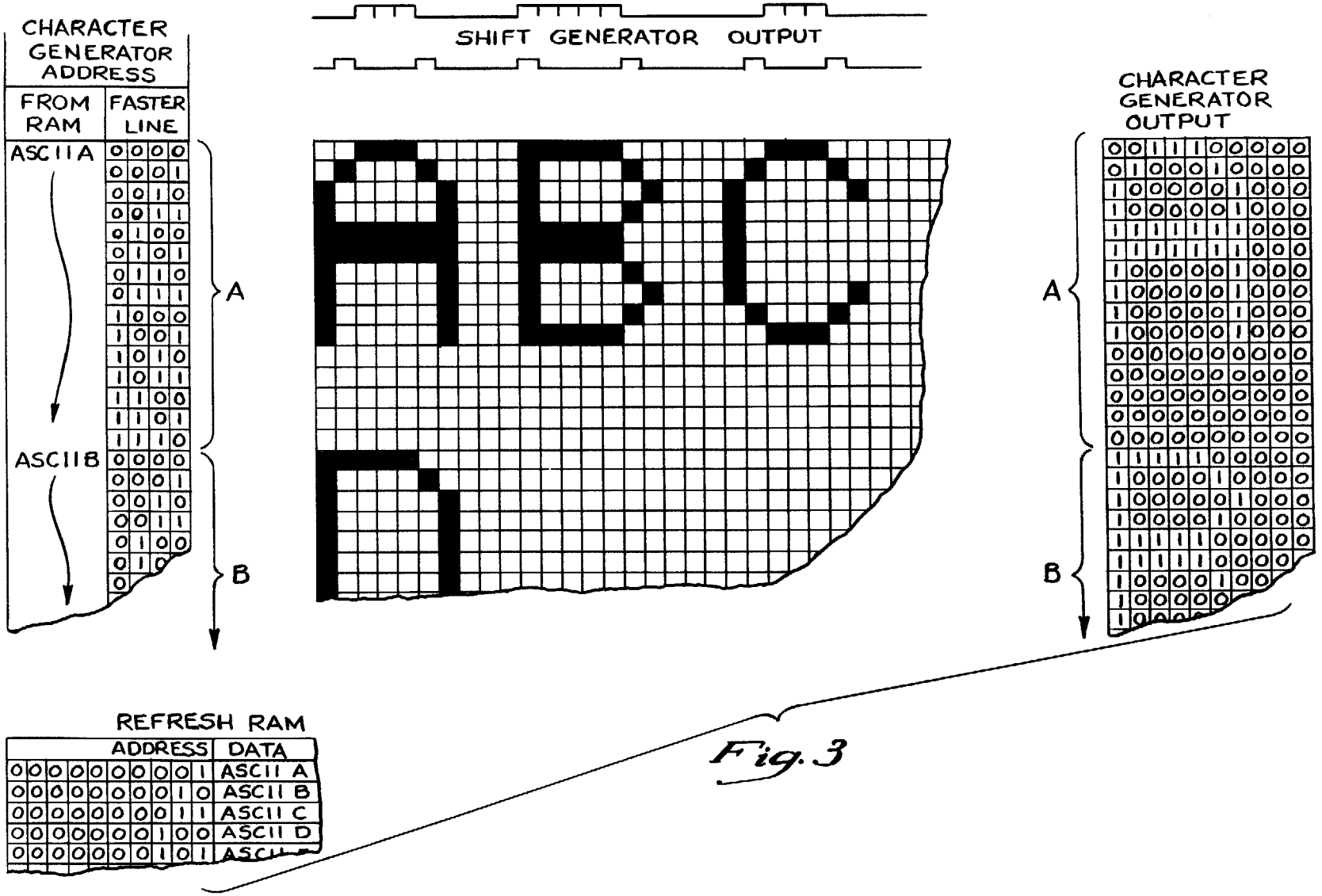
FIG. 3 is a graphic representation of the manner in which characters are displayed on the screen of FIG. 2 and showing, additionally, the data words and signal patterns provided by the character generator ROM and shift register, respectively, for generating these characters.

Referring now to FIG. 3, a small portion within the image area 27 is depicted, along with graphic representation of digital signals provided by the circuit of FIG. 1, to provide an understanding of the manner in which the graphics are generated on the screen 27.

The refresh RAM 19 of FIG. 1 includes an addressable data location for each and every character cell 55 within the image area 29 of the screen 27. Thus, in the graphic representation of FIG. 3, when the refresh RAM is provided with binary address 1, it will provide, at its output, the alpha-numeric character designation in ASCII code of the letter to be graphically depicted at the first character cell 55 in the first character line 51. In the graphic representation of FIG. 3, this code is shown as the letter A. Similarly, binary codes 2 and 3, etc., are shown storing the ASCII code equivalents for the letters B, C, etc. The refresh RAM is addressed by a write signal 59 (FIG. 1) to write ASCII codes in each of the character cells in order to provide intelligible graphics for the screen 27.

The refresh RAM is addressed in succession, in the manner to be described below, so that the ASCII codes, shown in FIG. 3, are output, in succession, to the character generator ROM 21. A raster line number input is also provided on line 61 in FIG. 1 to the character generator ROM 21. In response to these two address inputs, the character generator ROM 21 will provide, at its output, a binary word defining the graphics for the individual alpha-numeric characters according to the raster line being displayed at any time. Thus, as shown in FIG. 3, the character generator ROM is addressed with a binary word which includes the ASCII code for the letter in the most significant bits and the raster line number in the least significant bits. In response to this combined address, the character generator will provide a data word. For example, the data word for the first raster line of the letter A is 0,0,1,1,1,0,0,0,0,0.

When this first horizontal sweep across the screen 27 (FIG. 1) has been completed and the next successive raster line is being traced through the letter A, the refresh RAM 19 and raster line 61 inputs will provide the second address, shown in FIG. 3, such that the character generator ROM will output the data word 0,1,0,0,0,1,0,0,0,0.

These output data words from the character generator ROM 21 are supplied to a shift generator 23 which provides an output bit stream in accordance with the data word. Thus, the two bit streams shown in FIG. 3 provide the first and second raster line graphics of the letters A, B, C, in three sequential character locations on screen 27. It will be seen, through an examination of the character generator storage and shift generator output of FIG. 3, that the bit streams of the character generator output may be provided by simply shifting the output word for each raster line from the character generator read only memory 21 through the shift register 23.

FIG. 3 also shows four character cells 55*a*, 55*b*, 55*c*, and 55*d*, within the image area 29 (FIG. 1). The first three of these cells, 55*a*–55*c*, are on a first character line 51 (FIG. 1), while the last cell 55*d* is on the next successive character line 51. The cells 55*a*, 55*b*, 55*c* are in successive character locations 47 (FIG. 1). The shift register output of FIG. 3 is supplied to the video control 25 of FIG. 1 to turn the cathode ray gun on and off in the sequence shown by the waveform to generate the first and second raster lines of the letters A, B, and C in the character cells 55*a*, 55*b*, and 55*c*.

From this description, it will be understood that the refresh RAM is loaded with the characters which are to be displayed in the image area 29, in succession, by horizontal character designation and vertical line designation. When these ASCII codes are provided to the character generator ROM 21 along with an identification, through line 61, of the raster line being traced, the video control 25 can control the cathode ray gun to alternately energize and de-energize to generate the character graphics, shown in FIG. 3.

The circuit and graphics, thus far described, is generally well known in the prior art. The present invention involves the manner in which the address for the refresh RAM 59, the address 61 for the character generator ROM, and the video control signals 15 are generated.

Referring to FIG. 1, a horizontal counter 63 counts the output pulses from a clock signal generator 65. The counter 63 has a counting base equal to the entire number of character widths 47, 49, across the screen 27 (FIG. 2). Thus, in the example given, the horizontal counter 63 has a counting base of 100, and the rate of the clock 65 is selected to provide 100 output pulses for each horizontal raster line period for the cathode ray tube 11. It will be understood that the number 100 is not an even binary multiple. The counter 63 is a binary counter which, nevertheless, counts to this counting base without additional logic. Such additional logic would typically be required in the prior art to sense the binary number 100 and reset the counter 63. The present invention, however, accomplishes this function by connecting the overflow line 65 from the counter 63, which provides a digital pulse when the counter 63 is full, to a series of loading inputs 67 provided on the counter 63. This connection loads, in parallel, a digital starting number into the counter 63 when the counter overflows. The digital number provided by the load lines 67 is the two's compliment of the counting base, that is, the number 100. Thus, for example, if the counter 63 has a total binary count of 0 through 127, the two's compliment of the number 100 is the binary number 28. Thus, at overflow, the counter 63 will be loaded with the binary number 28, and will count from the binary number 28 to the binary number 127, or 100 counts, when it again overflows.

While it will be recognized that these output counts from the horizontal counter 63 are not satisfactory for addressing the refresh RAM 59, they do provide 100 successive binary words from a simple binary counter without additional logic.

In order to provide a proper set of binary numbers, beginning at zero, for addressing the RAM 59, a horizontal read only memory 69 is connected to the output of the horizontal counter 63. As will be seen from the following description, this ROM 69 not only provides the proper addresses for the character cells 55 (FIG. 2), but also provides the video control signals 15, required by the video electronics 13. This unique feature is possible because the entire video screen 27 of FIG. 2, including the margin areas 31, 33, is divided into horizontal character cells 47, 49 by the counter 63.

A series of bits 71 of the output words from the ROM 69 provide character address locations in the image area 29 in the horizontal direction. Thus, in the example given, when the counter 63, starting at a loaded count of 28, counts to 38, the 10-character wide margin 33 has been scanned by the cathode ray gun. When the counter 63 addresses the ROM 69 with address 38, the output word from the ROM 69 will provide the count of 0 in the address bits 71. Likewise, at count 39, the bit 71 will provide an output address 1. This process continues until the counter has reached a count of 117, the beginning of the right-hand margin 31 of the screen 27, at which point the horizontal address bit 71 will have counted 80 actual character locations within the image area 29.

A second group of bits 73 in the output words from the ROM 69 provides video control signals 15. Thus, for example, one of these bits may provide blanking signals 39 for the video control input 15 to the video electronics 13. The blanking bit will be a zero for all ROM 69 locations within the image field 29, but will be a one when the ROM 69 is addressed by the counter 63 with addresses 28 through 37 and 118 through 127, providing a continuous blanking signal 39 in the margins 33 and 31, respectively. In a similar manner, at count 127 of the counter 63, that is, at the end of the horizontal trace, a bit in the bit group 73 may provide the horizontal sync 43 signal to the video control line 15. The bit group 73 may include other control signals, such as, for example, those required to allow writing of the refresh RAM 69 during the retrace period, that is, when the cathode ray gun is sweeping the margins 31, 33.

The overload output 65 from the counter 63 also provides input pulses to a divider 75. Since, as shown in FIG. 3, 15 raster lines comprise each vertical character line 51, 53 of FIG. 2, the divider 75 divides this pulse train by 15, typically by counting to 15 and resetting repeatedly.

When the divider 75 resets, a pulse is provided on an input line 77 to a vertical counter 79. This counter 79 is provided with an overflow line 81, similar to the output 65 of the counter 63, which provides a pulse to loading inputs 83 to start the counter 79 at the two's compliment of 27, the total number of vertical character line positions 51, 53 in the screen 27 (FIG. 2). Through this technique, the counter 79 can be forced to count any counting base, in this instance, base 27, as required in the example.

In a manner identical to that described for the horizontal counter 63 and ROM 69, the counter 79 addresses a vertical ROM 85 to provide output data words, including vertical address bits 87 and vertical video control bits 89. The control bits 89 will include, for example, a blanking bit for providing the blanking signal 41, when the address from the counter 79 indicates that the cathode ray gun is scanning the upper and lower margin areas 35, 37. Likewise, when the counter 79 overflows, a bit in the video control field 89 will provide a vertical sync signal 45 to cause the video electronics 13 to vertically retrace the cathode ray gun.

It is important to note that, since there are 80 horizontal character spaces 47, 49 (FIG. 2), within the image area 29, and because 80 is not an even binary multiple, the output address bits 71 cannot be simply concatenated with vertical address base numbers provided from the bits 87 to provide sequential binary addresses which would completely fill the refresh RAM 59. For this reason, the vertical address bit field 87 provided by the ROM 85, will provide base addresses which can be added, rather than concatenated, to the bit field 71 in a binary adder 91 to provide successive binary addresses.

Thus, for example, in the 80 horizontal character field case, the vertical ROM 85 will provide, in bit field 87, the binary number zero to identify the upper-most horizontal character line within the image area 29. The next sequential number provided by the bit field 87 for the second horizontal character line, will be the binary number 80, the next will be 160, etc. It will be seen that these numbers, when added to the horizontal address bit field 71, will provide unique, successive addresses for each character cell 55 within the image area 29.

In the example of FIG. 1, if the counter 79 is a 5-bit binary counter, loaded with the two's compliment of 27, it will be loaded by the load line 83 with the binary number 5. Since two character line bits are required for the upper margin 35, when the binary counter 79 outputs the binary count 7, the vertical ROM 85 will generate, in the bit field 87, the binary number zero. When the counter 79 generates address 8, the ROM 85 will generate, in the bit field 87, the binary number 80. Likewise, at address 9, the bit field 87 will generate the binary number 160, etc. These numbers, when added to the successive binary numbers in the bit field 71, will generate contiguous successive addresses at the output of the adder 91 for the refresh RAM 59, one such address identifying each character cell 55 within the image area 29.

From this description, it can be seen that, through very simple logic, including a pair of counters, a pair of read only memories, a clock, and a divider circuit, all of the addressing for the refresh RAM 59 and all of the required video control signals for the video electronics 13, are provided.

In addition, the divider 15 provides a count output on a line 93 which generates the raster line number input 61, previously described, for the character generator ROM 21. Thus, for each vertical character line, the divider 75 will count from one to fifteen to identify the individual raster lines, so that the character generator ROM 21 can provide the shift register 23 with the proper data word to generate the graphics of FIG. 3.

The present invention provides an additional unique feature, in that it permits easy scrolling of a portion of the video graphics, while permitting a second portion to remain stationary. For example, referring to FIG. 2, it is often useful to hold the twenty-third line, identified as 95, of the image display stationary, while the remaining 22 lines are vertically scrolled. Such a display would be convenient for providing a stationary margin or tab display at the bottom of the scrolling image field 29. While, in the prior art, such displays have required complex logic, the present invention provides this feature through a simple enlargement of the vertical read only memory 85.

As previously explained, the vertical ROM 85, in the initial example, included at least 27 addressable locations to generate 27 unique character line addresses 51, 53 (FIG. 2). In fact, this read only memory, being a binary device, will have 32 addressable locations. If the image area 29 of FIG. 2 is considered an animation field, a first animation image will be provided with the vertical lines properly numbered from 1 through 23 in the image area 29. A second animation image could begin with line 22, followed by lines 1 through 21, and finally line 23. A third such animation image could begin with lines 21 and 22, followed by lines 1 through 20, followed by line 23. If these animation images are continued, it will be seen that lines 1 through 22 are effectively scrolled in the image area 29, with line 23 remaining stationary as is desired.

In order to accomplish this, the read only memory 85 is simply increased in size, to include 22 times as many addressable locations, or at least 32 times 22 addressable locations. The first 32 addressable locations will provide vertical output address bit fields 87 for the normal array, that is, lines 1 through 23, in proper order, as described in the first example. The second group of 32 addressable locations will provide the second animation image field when addressed in their normal order. Thus, address number count 40 (counter 79 loaded at 5, plus two margin counts, plus 32 count offset), will provide the output base address bit field 87 for line 22, while the next address location 41 will provide the bit field for line 1, etc.

In order to permit the counter 79 to address any one of these image fields, a scroll counter 97 provides base addresses or offsets which are concatenated with the output of the counter 79. The bits from the scroll counter 97 provide the most significant bits in the concatenation. Thus, when the scroll counter 97 outputs a count zero, the first image field will be addressed in the vertical ROM 85. When the scroll counter 97 produces output count 1, the successive output counts from the counter 79 will address the second 32-word field within the vertical ROM 85, generating the second image field on the screen 27.

From this description, it will be seen that virtually any arrangement of vertical lines 51, 53 within the image area 29 can be provided by the read only memory 85, allowing, through animation, partial scrolling, field inversion, etc., as the designer wishes. In each case, the image field presented is determined by the output count from the scroll counter 97. It will be understood that the computer, or other system driving the display, will provide a scroll command signal 98 to increment the counter 97.

Figure 4:
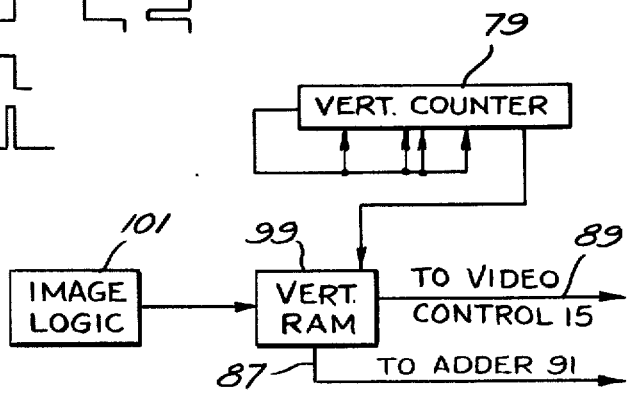
FIG. 4 is a block diagram schematic of an alternate embodiment, showing the manner in which a RAM replaces the vertical ROM of FIG. 1.

FIG. 4 shows a portion of the circuit of FIG. 1, altered to provide a further refinement of this scrolling technique. The remainder of the circuit is identical to FIG. 1. In this embodiment, instead of the vertical ROM 85, a vertical RAM 99 is provided to generate the output vertical base address bit field 87 for the adder 91. An image logic network 101 can be used to write addressable words in the vertical RAM 99 to provide virtually any vertical line arrangement which may be desired. Thus, if scrolling, as previously described were desired, instead of the large ROM 85, described in the previous example, a 32-location RAM 99 may be used. This RAM 99, in that example, is loaded by the image logic 101 with the successive address fields provided by the ROM 85 for each successive image field. Thus, the RAM 99 is simply loaded with the new addressable word field by the image logic 101 before each scrolling step. Use of the RAM 99 provides virtually limitless image arrangements on the screen 27.

From the preceding description, it can be seen that the present invention provides a low cost, relatively simple CRT controller, particularly adapted to graphic character displays, which utilizes counters 63 and 79 to identify, by character cell 55, the entire screen 27. This permits a pair of read only memories 69 and 85 or a read only memory 65 and RAM memory 99 to provide not only the necessary address words for the refresh RAM 59, but also the input video control signals 15, required by the video electronics 13. In addition, by duplication of the vertical ROM memory 85 and a scroll counter 97, partial scrolling of the image field or other vertical image patterns can be generated. Such scrolling is also generated with virtually limitless flexibility by replacing the vertical ROM 85 and scroll counter 97 with a vertical RAM 99 and image logic 101 for loading the RAM 99.

What is claimed is:

1. A circuit for generating addressing signals for a refresh memory in a CRT display, as well as video control signals for said CRT display, comprising:
   a counter synchronized to the sweep rate of the cathode ray gun of said CRT for generating count signals; and
   a memory, addressed by said count signals, for providing output data words defining said refresh memory addressing signals and said video control signals.

2. A circuit for generating addressing signals, as defined in claim 1, wherein said counter is synchronized to the horizontal sweep rate of said cathode ray gun.

3. A circuit for generating addressing signals, as defined in claim 2, additionally comprising:
   a second counter synchronized to the vertical sweep rate of said cathode ray gun of said CRT for generating second count signals; and
   a second memory addressed by said second count signals for providing second output data words defining said refresh memory addressing signals and said video control signals.

4. A circuit for generating addressing signals, as defined in claim 3, additionally comprising:
   an adder connected to add said output data words to said second output data words, said adder generating a sum signal for addressing said refresh memory.

5. A circuit for generating addressing signals, as defined in claim 4, wherein said memory and said second memory are read only memories.

6. A circuit for generating addressing signals, as defined in claim 5, additionally comprising:
   means for incrementing said second counter in response to resetting of said counter.

7. A circuit for generating addressing signals, as defined in claim 6, wherein said memory output data words are repeatedly sequenced through a counting base and wherein said second memory output data words are each separated from the next sequential output data word by an amount equal to said counting base.

8. A circuit for generating addressing signals, as defined in claim 3, wherein said memory comprises a read only memory and said second memory comprises a writable memory.

9. A circuit for generating addressing signals, as defined in claim 1, wherein said counter comprises:
   means for generating an output overflow signal when said counter overflows; and
   means responsive to said overflow signal for starting said counter at the two's compliment of the number of character widths on the screen of said CRT display.

10. A circuit for generating addressing signals, as defined in claim 1, wherein said counter includes means for providing an overflow signal, said circuit additionally comprising:

a divider responsive to said overflow signal for generating raster line counts for said refresh memory.

11. A circuit for generating addressing signals, as defined in claim 1, wherein said counter counts on a counting base equal to the number of character widths across the entire screen of said CRT display, said circuit additionally comprising:

means for starting said counter at a value equal to the two's compliment of said number of character widths.

12. A circuit for generating addressing signals, as defined in claim 1, additionally comprising:

means for adjusting said refresh memory addressing signals to scroll character lines on said CRT display.

13. A circuit for generating addressing signals, as defined in claim 12, wherein said means for adjusting said refresh memory addressing signals scrolls selected ones of said character lines on said CRT display.

14. A cathode ray tube character display controller, comprising:

means for dividing the screen of said cathode ray tube into character cells; and means responsive to said character cell dividing means for:

(a) dividing the screen of said cathode ray tube into an image portion and a margin portion, both of which are divided into said character cells;

(b) generating character addresses for said character cells within said image portion; and (c) generating video control signals for said character cells within said margin portion.

15. A cathode ray tube character display controller, as defined in claim 14, wherein said means for dividing comprises a counter synchronized to the sweep rate of said cathode ray tube.

16. A cathode ray tube character display controller, as defined in claim 15, wherein said means responsive to said character cell dividing means comprises a memory responsive to the output signals from said counter.

17. A cathode ray tube character display controller, as defined in claim 16, wherein said memory comprises a read only memory.

18. A cathode ray tube character display controller, as defined in claim 16, wherein said memory comprises a writable memory.

19. A cathode ray tube character display controller, as defined in claim 14, wherein said means for dividing the screen of said cathode ray tube comprises a horizontal and a vertical counter, said vertical counter synchronized to said horizontal counter.

20. A cathode ray tube character display controller, as defined in claim 19, wherein said means responsive to said character cell dividing means comprises:

a horizontal read only memory responsive to said horizontal counter; and a vertical memory responsive to said vertical counter.

21. A cathode ray tube character display controller, as defined in claim 20, wherein said horizontal memory comprises a read only memory.

22. A cathode ray tube character display controller, as defined in claim 20, wherein said vertical memory comprises a writable memory.

23. A circuit for permitting flexible scrolling of data on a cathode ray tube display, comprising:

a counter for providing output count signals synchronized to the location of the cathode ray gun of said CRT display on the screen of said display;

an addressable memory responsive to said count signals for generating signals defining the location of elements of said data on said display; and means for controlling said addressable memory to alter the response of said addressable memory to said count signals to permit a given one of said count signals, at different times, to selectively generate different ones of said signals defining locations.

24. A circuit for permitting flexible scrolling of data, as defined in claim 23, wherein said addressable memory comprises a read only memory storing plural data groups, each group generating signals defining the location of elements of said data on said display in response to said count signals, the location of elements on said display differing from group to group.

25. A circuit for permitting flexible scrolling of data, as defined in claim 24, wherein said means for controlling said addressable memory comprises:

means for generating offsetting base addresses for said read only memory, said means selecting one of said data groups for response to said count signals.

26. A circuit for permitting flexible scrolling of data, as defined in claim 23, wherein said addressable memory comprises a writable memory.

27. A circuit for permitting flexible scrolling of data, as defined in claim 26, wherein said means for controlling said addressable memory comprises an image logic network for writing data in said writable memory.

* * * * *